United States Patent [19]

Wolf

[11] Patent Number: 5,069,102

[45] Date of Patent: Dec. 3, 1991

[54] FLOOR PROTECTING ATTACHMENT FOR THE LEGS OF BOWED STRINGED MUSICAL INSTRUMENTS

[76] Inventor: Wilhelm Wolf, Hof ter Weydeweg 1, NL-3451 St Vleuten, Netherlands

[21] Appl. No.: 451,117

[22] Filed: Dec. 14, 1989

[30] Foreign Application Priority Data

Feb. 1, 1989 [DE] Fed. Rep. of Germany ... 8901094[U]
Oct. 21, 1989 [DE] Fed. Rep. of Germany ..... 3935160

[51] Int. Cl.[5] ..... G10D 1/02
[52] U.S. Cl. ..... 84/280; 248/188.9
[58] Field of Search ..... 84/280 C, 327, 421, 84/453; 248/188.9; 135/77, 78, 79, 80, 81

[56] References Cited

U.S. PATENT DOCUMENTS 2,447,080 8/1948 Meier ..... 84/280 C
3,949,773 4/1976 Marescalco ..... 135/78
4,355,777 10/1982 Greenstreet ..... 248/188.9 X

*Primary Examiner*—Brian W. Brown
*Attorney, Agent, or Firm*—Peter K. Kontler

[57] ABSTRACT

The leg of a cello, a double bass or an analogous relatively large bowed stringed musical instrument is prevented from directly contacting and scuffing and/or otherwise damaging the floor by an attachment which has a carrier member separably connectable to the leg and a supporting member which is permanently or separably connected to the carrier member and permanently or separably supports a hemispherical or conical floor contacting element of soft elastomeric material, preferably a material which contains or consists of silicone. The carrier member and/or the supporting member can be made of a metallic material.

17 Claims, 2 Drawing Sheets

FLOOR PROTECTING ATTACHMENT FOR THE LEGS OF BOWED STRINGED MUSICAL INSTRUMENTS

BACKGROUND OF THE INVENTION

The invention relates to improvements in attachments for the legs of relatively large bowed stringed musical instruments (typical examples of such musical instruments are cello and double bass).

The leg of a cello or double bass normally consist of a metallic material and abuts the floor when the instrument is in use. The free end of the metallic leg is likely to damage the floor and/or to slide along the floor with attendant inconvenience to the player. Damage to the floor is particularly undesirable if the musical instrument is played in a room wherein the floor is made of expensive wood (such as parquet) or a ceramic material. The leg is also likely to damage the carpets.

Heretofore known floor protecting attachments are simple cups which are made of rubber and are slipped onto the free end of the leg of a cello or an analogous musical instrument which is played while resting on the floor. Such conventional attachments are likely to protect the floor but are much less likely to prevent the leg from sliding along the floor. The reason is that, if the floor is waxed, a layer of wax rapidly deposits on the external surface of a rubber cup to thus affect the ability of the cup to offer adequate resistance to sliding along the floor. Thus, once a conventional cup-shaped attachment has accumulated a layer of wax or another floor coating material, it behaves just as a metallic body, i.e., it can readily slide along the floor. Moreover, once the wax-coated conventional attachment begins to slide along the floor, it is likely to leave unsightly scuff marks which affect the appearance of the floor. This is highly undesirable in concert halls as well as in properly maintained private homes, hotel lobbies and other establishments wherein a cello, a double bass or an analogous leg-bearing bowed stringed musical instrument is used.

OBJECTS OF THE INVENTION

An object of the invention is to provide a novel and improved attachment for the leg of a bowed stringed musical instrument which is constructed and assembled in such a way that it can adequately protect the floor and can also offer pronounced resistance to sliding along the floor, even after long periods of use on waxed or otherwise coated floors.

Another object of the invention is to provide a relatively simple, compact and inexpensive attachment which can be rapidly affixed to or detached from the leg of a musical instrument.

A further object of the invention is to provide an attachment which can be readily affixed to or detached from different types of legs of musical instruments.

An additional object of the invention is to provide an attachment wherein the floor contacting element can stand long periods of use even though it is sufficiently soft to prevent damage to the floor and/or sliding of the attachment along a waxed or otherwise coated floor.

Still another object of the invention is to provide an attachment wherein the floor contacting element can be readily removed for the purposes of inspection, cleaning or replacement while the other parts of the attachment remain affixed to the leg of a cello, a double bass or an analogous musical instrument.

SUMMARY OF THE INVENTION

The invention is embodied in a floor protecting attachment for a leg of a bowed stringed musical instrument, such as a cello or a double bass. The improved attachment comprises a substantially conical or hemispherical (hereinafter called conical) elastic floor contacing element which can consist of or which can contain silicone, and means for separably coupling the floor contacting element to the leg of a musical instrument.

The coupling means preferably includes a carrier member which is separably secured to the leg of the musical instrument, and a supporting member which connects the floor contacting element to the carrier member. The carrier member and/or the supporting member can consist of or can contain a suitable metallic material.

The supporting member can include a substantially plate-like holder a first side of which confronts the carrier member and a second side of which confronts the floor contacting element. The supporting member can further comprise annular bearing means for the floor contacting element at the second side of the plate-like holder. The floor contacting element preferably comprises a substantially circular base which is adjacent the second side of the plate-like holder and is surrounded by the bearing means. The inner diameter of the annular bearing means is smaller than the diameter of the circular base of the floor contacting element. The bearing means is or can be fixedly connected to the plate-like holder and can include two rings. One of the rings is disposed between the other ring and the plate-like holder, and the inner diameter of the one ring is greater than the inner diameter of the other ring. The bearing means and the plate-like holder together define a socket which separably receives a portion of the floor contacting element. Alternatively, such portion of the floor contacting element can be bonded to the plate-like holder and/or to the bearing means.

In accordance with one presently preferred embodiment, the carrier member includes a sleeve which serves to surround a portion of the leg of a musical instrument. Such sleeve preferably consists of a springy material and can be provided with at least one substantially longitudinally extending slot to facilitate the introduction of the leg.

In accordance with another presently preferred embodiment, the carrier member includes a second substantially plate-like holder (hereinafter called disc-shaped holder to distinguish from the substantially plate-like holder of the supporting member) having a side facing away from the plate-like holder, an arm which is connected to and extends beyond the aforementioned side of the disc-shaped holder, and means for separably clamping the arm to the leg of a musical instrument, preferably at a location which is spaced apart from the disc-shaped holder. The carrier member can further comprise a socket for the free end of the leg of a musical instrument, and such socket is provided at the aforementioned side of the disc-shaped holder. The socket can include a hollow cone (e.g., a hollow conical frustum) which consists of or at least contains natural or artificial rubber or other suitable elastomeric material.

One of the holders can be provided with at least one opening (e.g., in the form of an eccentrically located hole or slot), and the other holder can include at least one deformable extension (e.g., a spriny extension which tends to expand) which is disposed in the opening and frictionally engages the one holder to ensure that the two holders are reliably coupled to each other.

The clamping means can comprise two elastically deformable jaws or claws which serve to frictionally engage the leg of a musical instrument, and annular stressing means surrounding portions of the jaws and serving to urge the jaws against the leg.

Damper means (e.g., at least one elastic washer-like insert) can be interposed between the holders. The damper means is automatically deformed or stressed when the holders are properly affixed to each other, e.g., by the aforementioned deformable extension or extensions of the other holder.

The novel features which are considered as characteristic of the invention are set forth in particular in the appended claims. The improved attachment itself, however, both as to its construction and the mode of assembling and attaching the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
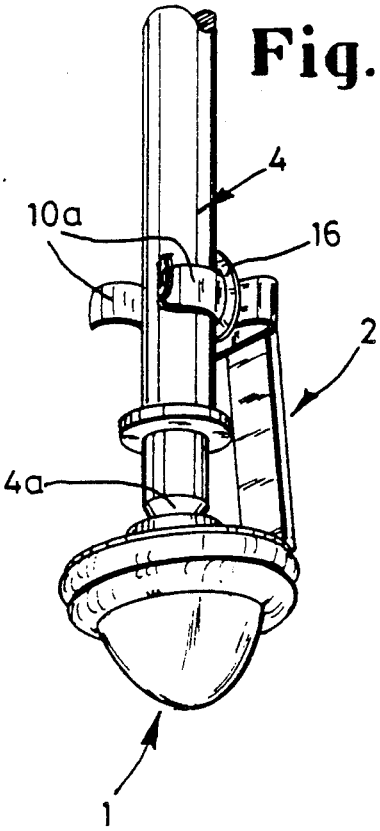
FIG. 1 is a fragmentary perspective view of a leg of a bowed stringed musical instrument and of an attachment which is shown in operative position and is constructed and assembled in accordance with a first embodiment of the invention.
Figure 2:
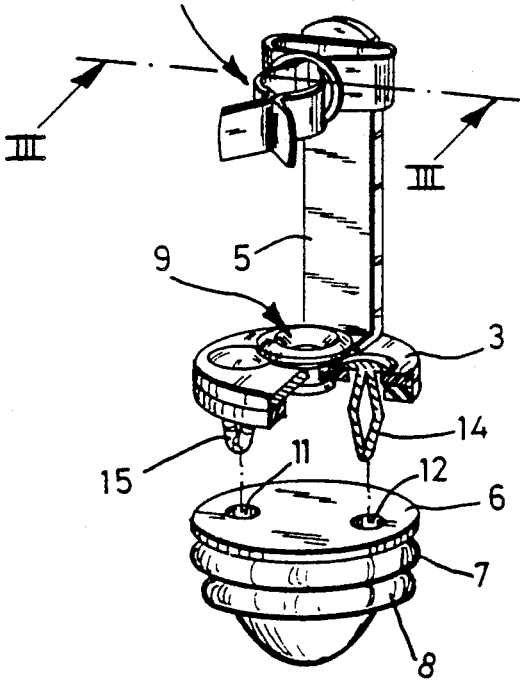
FIG. 2 is an enlarged exploded perspective view of the attachment which is shown in FIG. 1.
Figure 3:
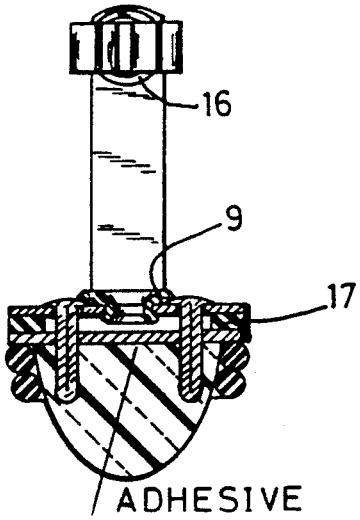
FIG. 3 is a vertical sectional view of the attachment substantially as seen in the direction of arrows from the line III—III of FIG. 2.

Referring first to FIGS. 1 to 3, there is shown an attachment which comprises a substantially conical or hemispherical (hereinafter called conical) floor contacting element 1 and a device 2 which serves as a means for separably coupling the element 1 to the leg 4 of a bowed stringed musical instrument, such as a cello or a double bass. The element 1 preferably consists of or contains silicone The coupling device 2 comprises a carrier member which is separably connectable to the leg 4, and a supporting member which serves to connect the element 1 to the carrier member. The supporting member comprises a plate-like holder 6 the upper side of which confronts the carrier member and the underside of which is adjacent the substantially circular base of the conical floor contacting element 1. The supporting member further includes an annular bearing consisting of two concentric rings 7 and 8 which are adjacent the underside of the holder 6. The ring 7 is adjacent and is affixed (e.g., bonded) to the underside of the holder 6 and is disposed between the holder and the ring 8. The ring 8 is bonded to the ring 7. The inner diameter of the ring 8 is somewhat smaller than the inner diameter of the ring 7, and these rings define with the holder 6 a socket for reception of the maximum-diameter (uppermost) portion or base of the element 1. The latter can be separably received in the socket. Alternatively, the element 1 can be bonded (e.g., by a layer of suitable adhesive as indicated by the legend) to the underside of the holder 6. It is also possible to bond the element 1 to the bearing including the rings 7, 8 in addition to or in lieu of bonding to the holder 6. Still further, it is possible to mechanically affix the element 1 to the holder 6, e.g., in a manner as shown in FIGS. 2 and 3. Thus, the holder 6 has two eccentric openings 11, 12 which are located diametrically opposite each other with reference to the axis of the preferably circular holder 6, and a disc-shaped holder 3 of the carrier member has two deformable extensions 14, 15 which exhibit a tendency to expand so that each thereof tends to assume a shape as shown in FIG. 2. When the extensions 14, 15 are forced into the respective openings 11, 12 and into the elastic material of the element 11, they tend to expand and thereby frictionally engage the holder 6 to ensure that the underside of the holder 3 is closely or immediately adjacent the upper side of the holder 6. An elastic damper 17 (e.g., a washer-like insert of rubber or other elastomeric material) is preferably inserted between the holders 3, 6 and is clamped between the marginal portions of these holders when the extensions 14, 15 are fully inserted to assume the positions which are shown in FIG. 3.

The rings 7, 8 of the annular bearing can be made of rubber or other elastomeric material, e.g., an elastomeric material which is not as readily deformable as the material of the element 1.

The carrier member of the coupling device 2 further comprises an elongated arm 5 which is rigid (e.g., integral) with the disc-shaped holder 3 and extends beyond the upper side of this holder. The upper end portion of the arm 5 is separably or permanently connected with a clamping unit 10 which is remote from the holder 3 and serves to separably secure the carrier member (including the parts 3, 5 and 10) to the leg 4 at a level above and away from the free end 4*a* of the leg. The free end 4*a* is or can be at least slightly conical (e.g., frustoconical) and extends into a centering socket 9 at the upper side of the holder 3. The socket 9 can be made of an elastically deformable material (e.g., a suitable plastic material) and constitutes or resembles the frustum of a hollow cone. The arm 5 is or can be substantially parallel with the leg 4 when the end portion 4*a* extends into the socket 9 and the clamping unit 10 properly engages the leg at a level above the socket 9. The clamping unit 10 comprises two springy jaws or claws 10*a* which straddle the leg 4 and are urged toward each other by an annular stressing device in the form of a ring 16 adjacent the upper end of the arm 5. The ring 16 ensures that the free end portions of the jaws 10*a* move toward each other and the arms reliably clamp the adjacent portion of the leg 4 irrespective of whether the diameter of the leg is relatively small or rather large.

The floor contacting element 1 can be supplied in assembled condition with the supporting member including the plate-like holder 6. This renders it possible to rapidly replace a damaged floor contacting element 1 with a fresh element. All that is necessary is to extract the extensions 14, 15 from the respective openings 11, 12 and to introduce these extensions into the openings 11, 12 of a different holder 6 which supports an intact floor contacting element 1.

It has been found that the floor contacting element 1 (particularly an element which consists of or contains silicone) can perform two important functions, namely that of preventing damage to the floor as a result of direct contact with the free end of the leg of a bowed stringed musical instrument, and that of preventing the leg from sliding along the floor.

The floor contacting element can be made of an elastomeric material known as "FLUMMI" (trademark) which exhibits a pronounced tendency to rapidly expand and to reassume its unstressed condition. Balls made of such material are used by children and are normally furnished in the form of spheres or ovoids. A spherical or ovoidal body can be readily halved to yield two floor contacting elements which can be used in the attachment of the present invention.

The improved coupling device including the carrier member 3, 5, 10 or 20 and the supporting member 6-8 or 6a-8 exhibits the important advantage that it adequately confines and thus shields from damage that (substantially flat) portion of the floor contacting element 1 which is most likely to undergo damage. As mentioned above, the supporting member 6-8 or 6a-8 defines a socket which can be said to resemble the frustum of a hollow cone and receives the maximum-diameter portion or base of the floor contacting element 1.

Figure 4:
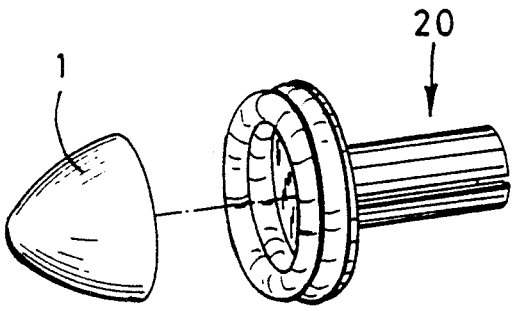
FIG. 4 is an exploded perspective view of a modified attachment.
Figure 5:
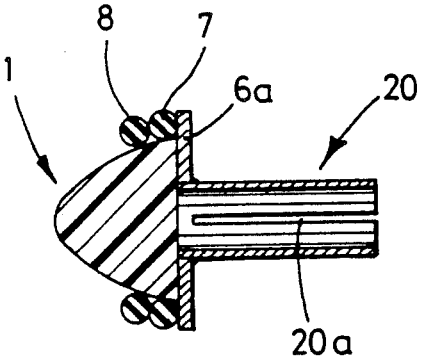
FIG. 5 is an axial sectional view of the modified attachment which is shown in assembled condition.

FIGS. 4 and 5 show a modified coupling device wherein the carrier member 20 is integral with the plate-like holder 6a of the supporting member for the floor contacting element 1. The plate-like holder 6 is bonded to the larger-diameter ring 7 of the bearing, and the ring 7 is bonded to the smaller-diameter ring 8. These rings cooperate with the holder 6a to define a socket for the maximum-diameter portion of the element 1. The latter can be loosely (i.e., detachably) received in the socket or it can be bonded to the ring 8, to the ring 7 and/or to the adjacent side of the holder 6a.

The carrier member 20 is an elongated sleeve which is preferably made of spring steel or other suitable springy metallic material and has one or more elongated axially parallel slots 20a to facilitate temporary expansion preparatory to introduction of the leg 4. The free end 4a of the leg 4 (not shown in FIGS. 4 and 5) abuts the base of the floor contacting element 1 when the coupling device of FIGS. 4 and 5 is properly attached to the leg of a cello or an analogous bowed stringed musical instrument. Alternatively, the holder 6a need not have a central aperture so that the free end 4a of a properly inserted leg 4 abuts the upper side of such modified holder. One end portion of the sleeve-like carrier member 20 is welded, soldered or otherwise fixedly secured to the holder 6a.

An advantage of the coupling device of FIGS. 4 and 5 is its simplicity and low cost.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Floor protecting attachment for a leg of a bowed stringed musical instrument, comprising a substantially conical elastic floor contacting element; and means for separably coupling the floor contacting element to the leg of the instrument, said coupling means comprising a carrier member which is separably secured to the leg of the instrument and a supporting member connecting said floor contacting element to said carrier member, said supporting member having a first side confronting said carrier member and a second side and said supporting member comprising annular bearing means for the floor contacting element at the second side of said supporting member, said floor contacting element including a substantially circular base which is adjacent the second side of said supporting member and has a first diameter, said bearing means surrounding said floor contacting element in the region of said base and having a second diameter smaller than said first diameter.

2. The attachment of claim 1, wherein at least said carrier member consists of or contains a metallic material.

3. The attachment of claim 1, wherein said floor contacting element consists of or contains silicone.

4. The attachment of claim 1, wherein said supporting member includes a substantially plate-like holder.

5. The attachment of claim 1, wherein said bearing means is fixedly connected to said supporting member.

6. The attachment of claim 1, wherein said bearing means includes a first ring and a second ring between said first ring and said supporting member and first ring having a first inner diameter and said second ring having a second inner diameter greater than said first inner diameter.

7. The attachment of claim 1, wherein said supporting member and said bearing means define a socket and said floor contacting element includes a portion which is separably received in said socket.

8. The attachment of claim 1, wherein said floor contacting element includes a portion which is bonded to said supporting member.

9. The attachment of claim 1, wherein said carrier member includes a sleeve which is arranged to surround a portion of the leg of a musical instrument.

10. The attachment of claim 9, wherein said sleeve consists of a springy material and has at least one substantially longitudinally extending slot.

11. The attachment of claim 1, wherein said carrier member includes a substantially disc-shaped holder having a side facing away from said supporting member, an arm connected with and extending beyond said side of said disc-shaped holder, and means for separably clamping said arm to the leg of a musical instrument.

12. The attachment of claim 11 for the leg of a musical instrument wherein the leg has a free end, wherein said carrier member further includes a socket for the free end of the leg of the musical instrument, said socket being provided at said side of said disc-shaped holder.

13. A floor protecting attachment for a leg of a bowed stringed musical instrument wherein the leg has a free end, comprising a substantially conical elastic floor contacting element; and means for separably coupling the floor contacting element to the leg of the instrument, said coupling means comprising a carrier member which is separably secured to the leg of the instrument and a supporting member connecting said floor contacting element to said carrier member, said supporting member including a substantially plate-like holder and said carrier member including a substantially disc-shaped holder having a side facing away from said plate-like holder, an arm connected with and extending beyond said side of said disc-shaped holder, and means for separably clamping said arm to the leg of a musical instrument, said carrier member further including a socket for the free end of the leg of the musical instrument, said socket being provided at said side of said disc-shaped holder and including a hollow cone and containing an elastomeric material.

14. Floor protecting attachment for the leg of a bowed stringed musical instrument, comprising a substantially conical elastic floor contacting element; and means for separably coupling the floor contacting element to the leg of the musical instrument, said coupling means including a carrier member which is separably secured to the leg of the instrument and a supporting member connecting said floor contacting element to said carrier, said supporting member including a substantially plate-like holder and said carrier member including a substantially disc-shaped holder having a side facing away from said plate-like holder, an arm connected with and extending beyond said side of said disc-shaped holder, and means for separably clamping said arm to the leg of a musical instrument, one of said holders having at least one opening and the other of said holders including at least one deformable extension disposed in said opening and frictionally engaging said one holder.

15. Floor protecting attachment for the leg of a bowed stringed musical instrument, comprising a substantially conical elastic floor contacting element; and means for separably coupling the floor contacting element to the leg of the musical instrument, said coupling means including a carrier member which is separably secured to the leg of the instrument and a supporting member connecting said floor contacting element to said carrier, said supporrting member including a substantially plate-like holder and said carrier member including a substantially disc-shaped holder having a side facing away from said plate-like holder, an arm connected with an extending beyond said side of said disc-shaped holder, and means for separably clamping said arm to the leg of a musical instrument, said clamping means comprising two elastically deformable jaws arranged to frictionally engage the leg of a musical instrument and annular stressing means surrounding portions of and arranged to urge said jaws against the leg.

16. Floor protecting attachment for the leg of a bowed stringed musical instrument, comprising a substantially conical elastic floor contacting element; means for separably coupling the floor contacting element to the leg of the musical instrument, said coupling means including a carrier member which is separably secured to the leg of the instrument and a supporting member connecting said floor contacting element to said carrier, said supporting member including a substantially plate-like holder and said carrier member including a substantially disc-shaped holder having a side facing away from said plate-like holder, an arm connected with and extending beyond said side of said disc-shaped holder, and means for separably clamping said arm to the leg of a musical instrument; damper means interposed between said holders; and means for separably affixing said holders to each other.

17. The attachment of claim 16, wherein said damper means comprises at least one elastic insert.

* * * * *